US005791264A

United States Patent [19]

McCraney

[11] Patent Number: 5,791,264

[45] Date of Patent: Aug. 11, 1998

[54] WATER HEATER STAND

[76] Inventor: Jeffrey McCraney, 1918 W. Chestnut St., Santa Ana, Calif. 92703

[21] Appl. No.: 850,069

[22] Filed: May 2, 1997

[51] Int. Cl.[6] ..... A47B 13/02

[52] U.S. Cl. ..... 108/151; 108/157.15; 403/282; 403/274

[58] Field of Search ..... 248/188, 188.1, 248/151, 150; 108/27, 151, 156, 157.1, 159, 183, 187, 157.15, 157.18, 158.11, 158.12, 186, 180, 153.1, 157.16; 403/353, 282, 400, 274

[56] References Cited

U.S. PATENT DOCUMENTS

| | | | |
|---|---|---|---|
| 1,473,817 | 11/1923 | Gorsline | 108/157.17 |
| 1,574,608 | 2/1926 | Cordley et al. | 248/150 |
| 1,621,245 | 3/1927 | Flowers | 108/161 X |
| 1,760,036 | 5/1930 | Bellows | 108/157.18 |
| 2,324,252 | 7/1943 | Woelfer | 108/157.15 |
| 2,474,668 | 6/1949 | Herbolsheimer | 248/188 |
| 3,519,233 | 7/1970 | Logsdon | 248/146 |
| 3,875,873 | 4/1975 | Howitt | 248/151 X |

*Primary Examiner*—Peter M. Cuomo
*Assistant Examiner*—Janet M. Wilkens
*Attorney, Agent, or Firm*—Edgar W. Averill, Jr.

[57] ABSTRACT

A kit for assembling a stand for supporting a water heater above the floor. The stand is fabricated from sheet metal pieces and may be assembled without the use of nuts and bolts. A circular sheet metal top member has pockets for four generally C-shaped legs. The legs are held together near the bottom by a cross-brace.

9 Claims, 3 Drawing Sheets

WATER HEATER STAND

BACKGROUND OF THE INVENTION

The field of the invention is broadly tables and the invention relates more particularly to tables fabricated from sheet metal and still more particularly to tables useful for supporting a water heater.

It has been recognized that a safety hazard exists by the mounting of a water heater directly on a garage floor. If a can of gasoline is spilled anywhere in the garage the fumes will flow along the floor much like a liquid would and reach a height where they can be ignited by the pilot light of the water heater. By raising the water heater a foot and a half off the ground this same gasoline spill will cause no fire at all. Some codes require water heaters to be mounted off the floor, but most do not. Water heaters are typically supported by short metal legs such as that shown in U.S. Pat. No. 3,110,302. Another water heater with short legs is shown in U.S. Pat. No. 3,124,110. A water heater stand with a drain pan is shown in U.S. Pat. No. 3,519,233 where the various elements of the stand are riveted together. A plastic water heater stand is shown in U.S. Pat. No. 5,368,263 and this stand has rings which permit the height of the stand to be adjusted.

Particularly for after market use by a do-it-yourselfer, it is important that a stand be very easy to assemble with a minimum number of tools. It should be able to be shipped in a disassembled form to permit the parts to be placed into a relatively small container. Another disadvantage of the common nut and bolt approach to assembling parts is that the nuts can work loose with time and provide yet another safety hazard. Also, parts become lost in unwrapping and any shortage of nuts and bolts causes customer unhappiness.

BRIEF SUMMARY OF THE INVENTION

It is an object of the present invention to provide a water heater stand fabricated from sheet metal which can be assembled without the use of nuts and bolts and yet one that provides a very secure support which cannot work loose with time.

The present invention is for a kit for assembling a stand for supporting a water heater above the floor. The stand is fabricated from sheet metal pieces and has a top member with a generally flat base. The flat base terminates in an upwardly extending wall portion around the periphery of the base. The wall portion terminates in an outwardly extending peripheral floor which at its outer edge extends downwardly to an outer rim. Either the wall portion or the outer rim has four oppositely disposed pairs of protrusions forming four leg seats between the pairs of protrusions. Four legs are also fabricated from sheet metal having a C-shaped cross-section and extend from a top to a foot. The top fits into the leg seats and each of the legs also have a cross-member attachment fitting. Two cross-members are riveted together at their midpoint and the ends of the cross-members include means for affixing the cross-members to the attachment fitting on each leg. Preferably the top member is circular and has a bead at the bottom. Also preferably the legs have a tab which may be bent upwardly over the bead to hold the legs in place.

DESCRIPTION OF THE PREFERRED EMBODIMENTS

Figure 1:
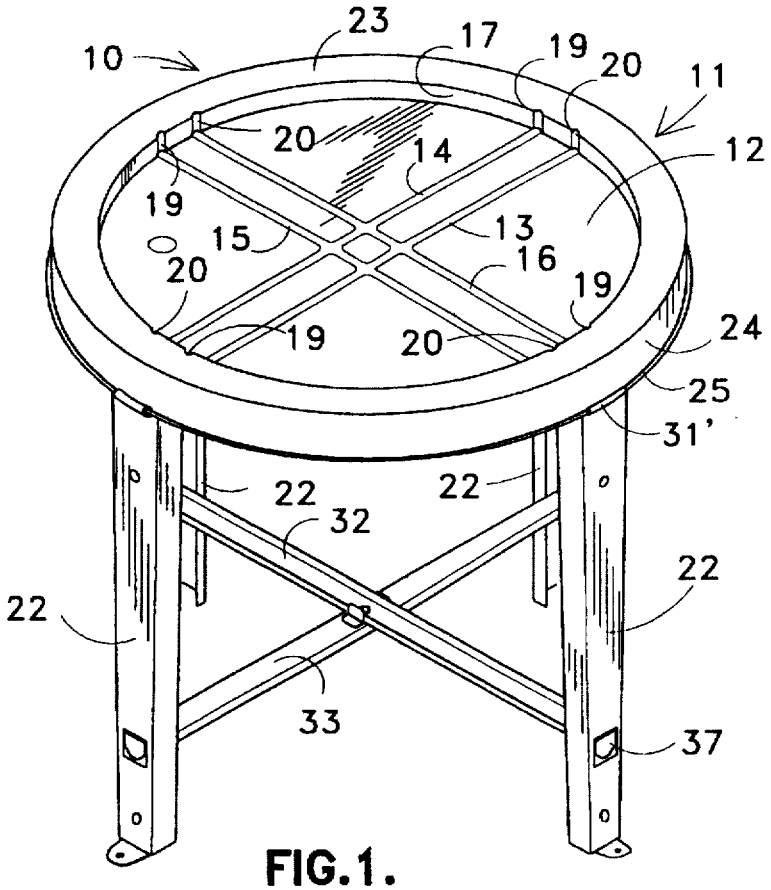
FIG. 1 is perspective view showing the top and front of the stand of the present invention.
Figure 4:
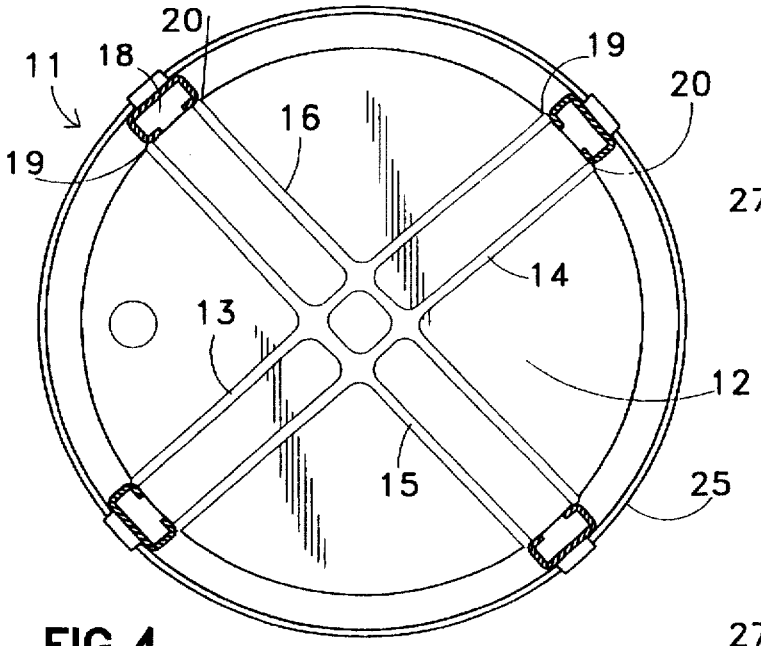
FIG. 4 is a cross-sectional view taken just below the generally flat base showing the legs seated in the base.

The stand of the present invention is shown in FIG. 1 in perspective view and indicated generally by reference character 10. Stand 10 has a top member 11 which has a generally flat base 12. Generally flat base 12 has four downwardly formed reinforcing ribs 13, 14, 15 and 16. These ribs extend into an upwardly extending wall portion 17 where they form a leg seat 18 shown best in FIG. 4. The pair of protrusions are indicated by reference characters 19 and 20 where they securely position the top 21 of leg 22. The four legs are identical and will be indicated by the same reference characters.

The top member 11 has an outwardly extending peripheral floor 23 extending from the upwardly extending wall portion 17. This extends outwardly to a downwardly extending outer rim 24. Rim 24 terminates in a round bead 25. This bead is shown in enlarged cross-sectional view in FIGS. 9 and 10.

Top member 11 can be economically fabricated from 20 gauge galvanized steel and the assembled stand is capable of supporting a 100 gallon hot water heater weighing up to 1200 lbs. Although it typically is expected to be used with 50 gallon water heaters weighing between 500 and 600 lbs.

Figure 2:
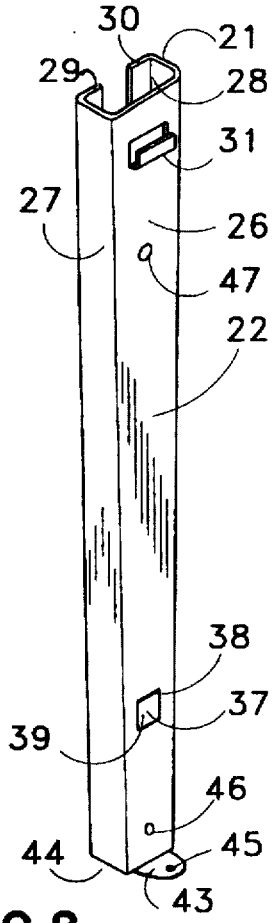
FIG. 2 is an enlarged perspective view of one of the legs of the stand of FIG. 1.
Figure 9:
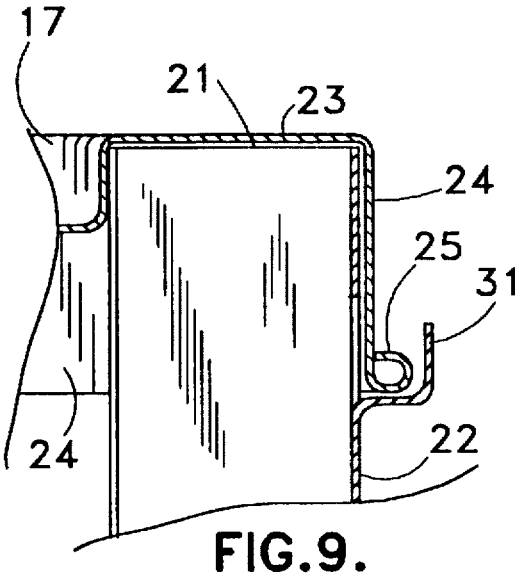
FIG. 9 is a cross-sectional view showing the outer portion of the top member with a leg seated in one of the leg seats and showing a tab on the leg surrounding the bottom and outer side of the bead of the top member.
Figure 10:
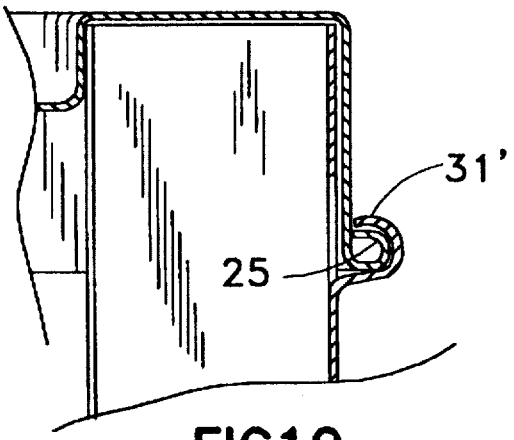
FIG. 10 is a cross-sectional view analogous to FIG. 9, except that the tab is bent over the bead.

Returning now to FIG. 2, leg 22 can be seen to be generally C-shaped in cross-section, having a front face 26, sides 27 and 28 and two rear flanges 29 and 30. An upper tab 31 is lanced out of front face 26 and is used to grip bead 25 as shown in FIGS. 9 and 10. Tab 31 is simply tapped with a hammer once the top member 11 has been inserted over a leg 22 to form bent tab 31. The top 21 abuts the underside of outwardly extending peripheral floor 23 and the rear flanges 29 and 30 abut the inner surface of upwardly extending wall portion 17. The protrusions 19 and 20 abut the sides and thus, the leg is securely supported at the top by top member 11.

Figure 3:
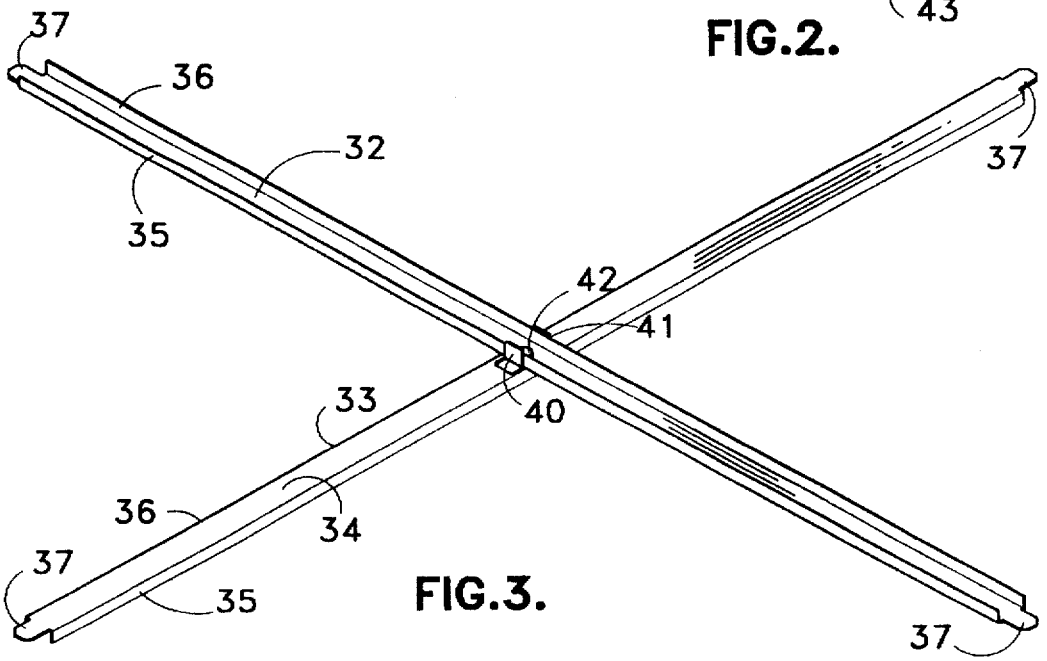
FIG. 3 is an enlarged perspective view of the cross-members of the stand of FIG. 1.
Figure 6:
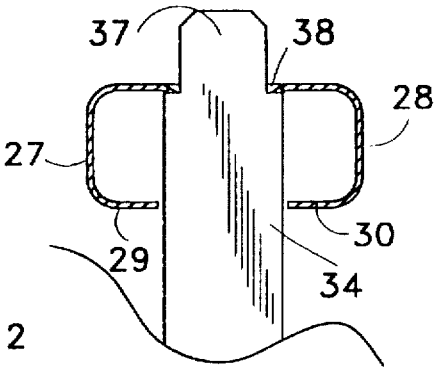
FIG. 6 is an enlarged cross-sectional view looking down on one of the legs just above its point of attachment to a cross-member showing the outwardly extending tab of the cross-member.
Figure 7:
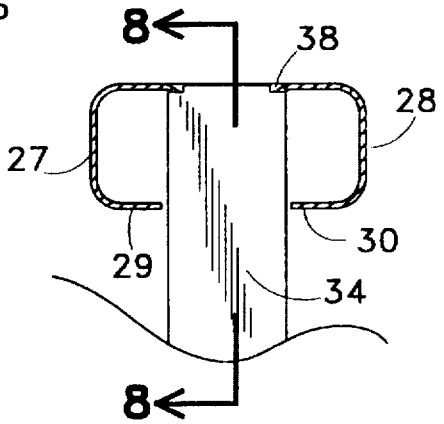
FIG. 7 is a view analogous to FIG. 6, except that the tab is bent downwardly.
Figure 5:
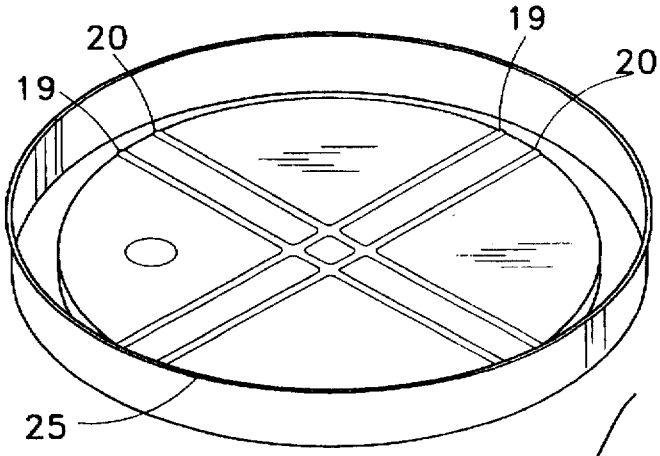
FIG. 5 is a perspective view showing the bottom of the base.
Figure 8:
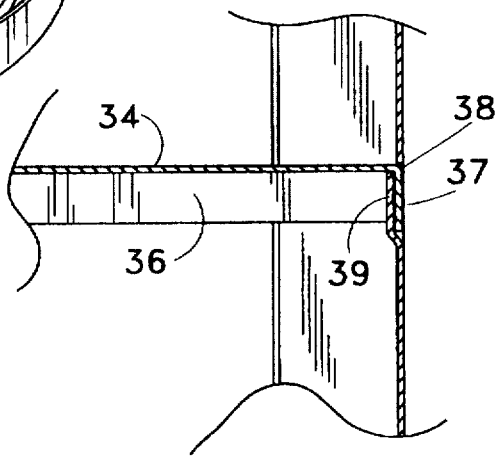
FIG. 8 is a cross-sectional view taken along line 8—8 of FIG. 7.

The legs are also supported by a pair of cross-braces comprising a first cross-member 32 and a second cross-member 33 shown in perspective view in FIG. 3. The cross-members are also fabricated from 20 gauge galvanized steel and have a base 34 and a pair of edge flanges 35 and 36. While galvanized steel is preferred, other material such as galvalum or aluminized steel can be used. A tab 37 is formed at each end of each cross-member. The tabs 37 fit within a slot 38 located at the top of a generally rectangular indentation 39. The tab 37 is bent downwardly as shown in FIGS. 6, 7 and 8. In FIG. 6, tab 37 extends outwardly and in FIG. 7 it has been bent downwardly. Generally rectangular indentation 39 provides a pocket for the placement of a tab as shown in FIG. 8.

It is also preferable that the first and second cross-members 32 and 33 be secured at right angles to one another. This is accomplished by a pair of tabs 40 and 41 shown in FIG. 3. These tabs are lanced out of the base 34 of cross-member 33. The two cross-members are held together by a rivet 42 which is installed in the factory. After the kit has been unpacked the cross-members can be moved into a right angled configuration as shown in FIG. 3 and lanced tabs 40 and 41 bent into position to hold the cross-members in place at a right angled configuration.

The protrusions 19 and 20 have been shown to securely hold the top of the sheet metal leg and they have a depth of ¼" and a width of ½". The corners of the leg are slightly rounded as shown in FIGS. 2, 4, 6 and 7, and the protrusions 19 and 20 abut the rounded corners of the legs which are capable of springing inwardly to form a firm holding of the top part of the leg.

Each leg also has a tab 43 at the foot 44. A hole 45 is formed through the tab which permits the bolting down of the bottom of the feet into the concrete or other flooring. Holes 46 and 47 are also formed in the face 26 of leg 22 and permit the attachment or securement of the legs thereby.

The result is a stand which is easy to assembly and yet sufficiently secure to support a water heater weighing up to 1200 lbs. The stand does not require the use of nuts and bolts and only a hammer is required to assemble the stand.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A stand for supporting a water heater above a floor, said stand being fabricated from sheet metal pieces, said stand comprising:

a top member having a generally flat base, said base terminating in an upwardly extending wall portion around its periphery, said wall portion terminating in an outwardly extending peripheral floor, which, in turn, extends to a downwardly extending outer rim, at least one of said wall portion and said outer rim having four oppositely disposed pairs of protrusions forming four leg seats between the pairs of protrusions, the outer rim and the wall portion;

four legs, each leg having a C-shaped cross section including a front face, two sides and two rear flanges and extending from a leg top to a leg foot, said leg top also having a C-shaped cross section fitting into said leg seats so that the two rear flanges abut said upwardly extending wall portion, each of said legs having a cross member attachment fitting; and first and second cross members, each cross member having a midpoint between a pair of ends and including means for affixing the first cross member to the second cross member at the midpoints thereof and each cross members including an attachment fitting adjacent each end thereof adapted to connect with said attachment fitting on each leg.

2. The stand for supporting the water heater of claim 1 wherein said generally flat base is circular in shape.

3. The stand for supporting the water heater of claim 1 wherein said four oppositely disposed pairs of protrusions are four pairs of ribs formed in the sheet metal upwardly extending wall portion.

4. The stand for supporting the water heater of claim 3 wherein each of said pair of ribs continue across said generally flat base to form reinforcing ribs.

5. The stand for supporting the water heater of claim 1 further including a bead formed at a bottom of said downwardly extending outer rim.

6. The stand for supporting the water heater of claim 5 wherein each leg has an outwardly extending tab positioned so that it about contacts said bead when said top of each of said legs is placed in said leg seats, said tab being malleable and bendable about said bead to secure the leg in said leg seat.

7. The stand for supporting the water heater of claim 1 wherein said attachment fitting adjacent each end of said first and second cross members and said attachment fitting on each leg comprises a slot formed through a face of said leg and each end of both of said cross members has a tab extending outwardly therefrom.

8. A stand for supporting a water heater above a floor, said stand being fabricated from sheet metal pieces, said stand comprising:

a top member having a generally flat, circular base, said base terminating in an upwardly extending vertical wall portion around its periphery, said vertical wall portion terminating in an outwardly extending peripheral, circular floor, which, in turn, extends to a downwardly extending outer circular rim terminating in a bead, at least one of said wall portion and said outer rim having four oppositely disposed pairs of protrusions forming four leg seats between the pairs of protrusions, the outer rim and the wall portion;

four legs, each leg having a C-shaped cross section and extending from a top to a foot, said top fitting into said leg seats, each of said legs having a cross member attachment fitting; and first and second cross members, each cross member having a midpoint between a pair of ends and including means for affixing the first cross member to the second cross member at the midpoints thereof and each cross members including an attachment fitting adjacent each end thereof adapted to connect with said attachment fitting on each leg.

9. The stand for supporting the water heater of claim 8 wherein said generally flat base has four reinforcing ribs which extend upwardly into said upwardly extending wall portion to form said four leg seats.

* * * * *